US009149821B2

(12) United States Patent
Micheli et al.

(10) Patent No.: US 9,149,821 B2
(45) Date of Patent: Oct. 6, 2015

(54) CORDLESS SPRAY DEVICE

(71) Applicant: Finishing Brands Holdings Inc., Minneapolis, MN (US)

(72) Inventors: Paul R. Micheli, Glen Ellyn, IL (US); Steven A. Myers, Fremont, OH (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 99 days.

(21) Appl. No.: 13/787,658

(22) Filed: Mar. 6, 2013

(65) Prior Publication Data

US 2013/0264398 A1 Oct. 10, 2013

Related U.S. Application Data

(60) Provisional application No. 61/608,010, filed on Mar. 7, 2012.

(51) Int. Cl.

| | |
|---|---|
| ***B05B 3/10*** | (2006.01) |
| ***B05B 7/24*** | (2006.01) |
| ***B05B 3/02*** | (2006.01) |
| ***B05B 9/01*** | (2006.01) |
| ***B05B 9/03*** | (2006.01) |
| ***B05B 15/04*** | (2006.01) |

(52) U.S. Cl.

CPC ..... *B05B 7/2467* (2013.01); *B05B 3/022* (2013.01); *B05B 3/105* (2013.01); *B05B 3/1014* (2013.01); *B05B 9/01* (2013.01); *B05B 9/03* (2013.01); *B05B 15/0443* (2013.01)

(58) Field of Classification Search

CPC ..... B05B 3/022; B05B 3/105; B05B 3/0486; B05B 3/0418; B05B 5/04; B05B 5/0403; B05B 5/0407; A01M 7/0003–7/0046; B01F 3/04028; B01F 3/04035; B01F 3/04042

USPC ..... 239/215, 222.11–224, 288.5, 225, 214, 239/231, 499, 505

See application file for complete search history.

(56) References Cited

U.S. PATENT DOCUMENTS

| | | | |
|---|---|---|---|
| 1,881,570 | A | 10/1932 | Hermann |
| 4,030,665 | A | 6/1977 | Koyama |

(Continued)

FOREIGN PATENT DOCUMENTS

| | | | |
|---|---|---|---|
| DE | 102009053770 | A1 | 5/2011 |
| EP | 1866100 | A1 | 12/2007 |

(Continued)

OTHER PUBLICATIONS

PCT Invitation to Pay Additional Fees; PCT Application No. PCT/US2013/029701; dated Jul. 16, 2013.

*Primary Examiner* — Arthur O Hall
*Assistant Examiner* — Juan C Barrera
(74) *Attorney, Agent, or Firm* — Fletcher Yoder P.C.

(57) ABSTRACT

A system may include a portable spray device having a battery powered drive, a rotary atomizer driven by the battery powered drive, and a syringe configured to supply a liquid to the rotary atomizer, wherein the rotary atomizer is configured to rotate to atomize the liquid into a spray. A system may include a portable spray device having a barrel portion with a first syringe fluidly coupled to a spray head, and a handle portion coupled to the barrel portion via a break-action mechanism. The handle portion may include an actuator assembly configured to drive a first plunger in the first syringe.

20 Claims, 9 Drawing Sheets

(56) References Cited

U.S. PATENT DOCUMENTS

| | | | | |
|---|---|---|---|---|
| 4,392,614 | A * | 7/1983 | Groth et al. | 239/215 |
| 4,427,074 | A * | 1/1984 | Wollin | 169/46 |
| 4,605,993 | A | 8/1986 | Zelina, Jr. | |
| 5,131,598 | A * | 7/1992 | Hoogeveen, Jr. | 239/223 |
| 5,211,171 | A | 5/1993 | Choromokos | |
| 5,338,495 | A * | 8/1994 | Steiner et al. | 261/28 |
| 5,752,662 | A * | 5/1998 | Hsu | 239/215 |
| 6,350,040 | B1 | 2/2002 | Parker | |
| 6,378,845 | B1 * | 4/2002 | Hsu | 261/28 |
| 6,464,663 | B1 * | 10/2002 | Zinger | 604/82 |
| 7,303,149 | B1 | 12/2007 | Huang | |
| 8,025,243 | B2 | 9/2011 | Charpie | |
| 2004/0251321 | A1 | 12/2004 | Ye et al. | |
| 2005/0284963 | A1 | 12/2005 | Reedy | |
| 2006/0219824 | A1 | 10/2006 | Alexander et al. | |
| 2006/0273195 | A1 * | 12/2006 | Junkel | 239/222.11 |
| 2008/0272150 | A1 | 11/2008 | Hahn et al. | |

FOREIGN PATENT DOCUMENTS

| | | |
|---|---|---|
| FR | 675417 | 2/1930 |
| FR | 2082636 | 12/1971 |
| GB | 1105651 A | 3/1968 |
| JP | H04197464 A | 7/1992 |

* cited by examiner

CORDLESS SPRAY DEVICE

CROSS REFERENCE TO RELATED APPLICATION

This application claims priority to and benefit of U.S. Provisional Patent Application No. 61/608,010 entitled "CORDLESS SPRAY DEVICE", filed Mar. 7, 2012, which is herein incorporated by reference in its entirety.

BACKGROUND

The invention relates generally to systems and methods for spraying substances, such as coating fluids (e.g., paint).

A variety of spray devices may be used to apply a spray to a target object. For example, spray devices often employ a gas, such as pressurized air, to atomize a liquid (e.g., paint) to generate a spray, which is then directed toward the target object to create a coating. Unfortunately, these spray devices require a source of pressurized air, such as a compressor or a compressed gas tank. By further example, spray devices often require one or more connections with external equipment, such as air supply conduits, liquid supply conduits (e.g., paint conduits), electrical cords, and so forth. Unfortunately, these connections limit the portability and ease of use of the spray devices. Accordingly, a need exists for an improved spray device.

BRIEF DESCRIPTION

A system, in certain embodiments, may include a portable spray device having a battery powered drive, a rotary atomizer driven by the battery powered drive, and a syringe configured to supply a liquid to the rotary atomizer, wherein the rotary atomizer is configured to rotate to atomize the liquid into a spray.

A portable spray device, in certain embodiments, may include a barrel portion having a first syringe fluidly coupled to a spray head, and a handle portion coupled to the barrel portion via a break-action mechanism. The handle portion may include an actuator assembly configured to drive a first plunger in the first syringe.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
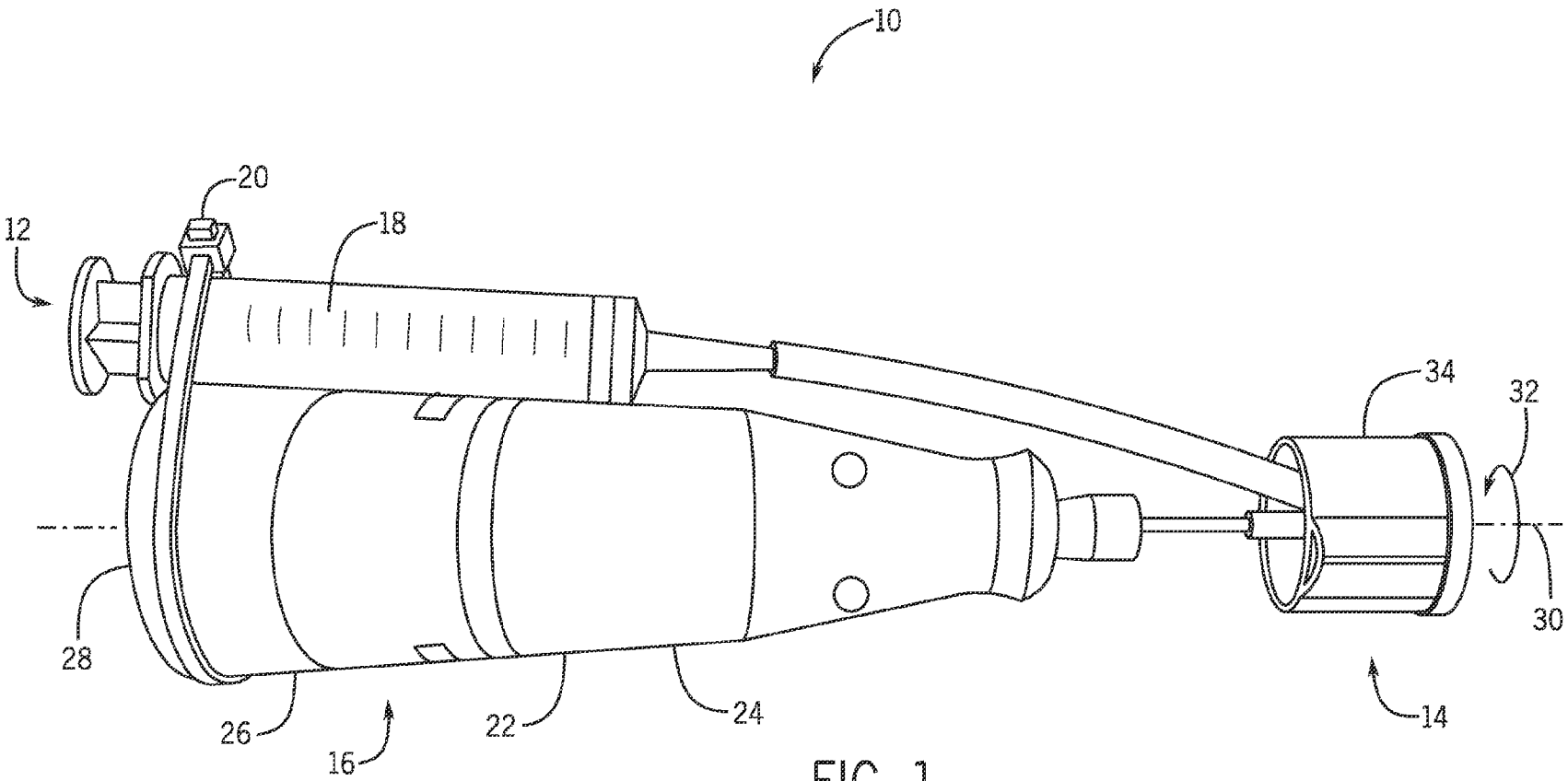
FIG. 1 is a side perspective view of an embodiment of a cordless spray device having a syringe to supply a substance to a rotary atomizer driven by a battery powered drive.

FIG. 1 is a side perspective view of an embodiment of a cordless spray device 10 having a syringe 12 to supply a substance to a rotary atomizer 14 driven by a battery powered drive 16. As illustrated, the syringe 12 may be a plastic syringe with markings 18 to indicate a quantity of liquid applied to the rotary atomizer 14. Furthermore, the syringe 12 may be removably mounted to the battery powered drive 16 via a variety of mounting features 20, such as a strap, clamp, screws, bolts, snap-fit couplings, or other fasteners. For example, the mounting features 20 may be an adjustable strap, such as a metal or plastic strap, with a plurality of positions to adjust the tightness of clamping the syringe 12 onto the battery powered drive 16. The syringe 12 also may be a reusable syringe, a disposable syringe, a recyclable syringe, a pre-filled syringe (e.g., pre-filled with a paint or other coating liquid), a user fillable syringe, or any combination thereof As appreciated, the battery powered drive 16 includes a body or casing 22 that supports an internal drive 24 (e.g., an electric motor) coupled to a battery 26. In other embodiments, the battery 26 may be replaced or supplemented with another power supply contained within the casing 22, e.g., one or more capacitors. Furthermore, the battery powered drive 16 may be a rechargeable unit, and thus may include a recharge connection 28, such as a docking station connection.

As discussed in further detail below, the rotary atomizer 14 may be driven by the internal drive 24 to rotate about a rotational axis 30, as indicated by arrow 32. As the rotary atomizer 14 rotates, the liquid from the syringe 12 may be fed to the atomizer 14, such that the atomizer 14 spins the liquid to cause atomization of the liquid into a spray. For example, the rotary atomizer 14 may include a bell cup 34 that spins about the axis 30 to cause rotary atomization of the liquid. In certain embodiments, the rotary atomizer 14 may include a plurality of propellers to aid in the rotary atomization of the liquid and/or an adjustable guard to aid in the direction of the spray away from the cordless spray device 10.

Figure 2:
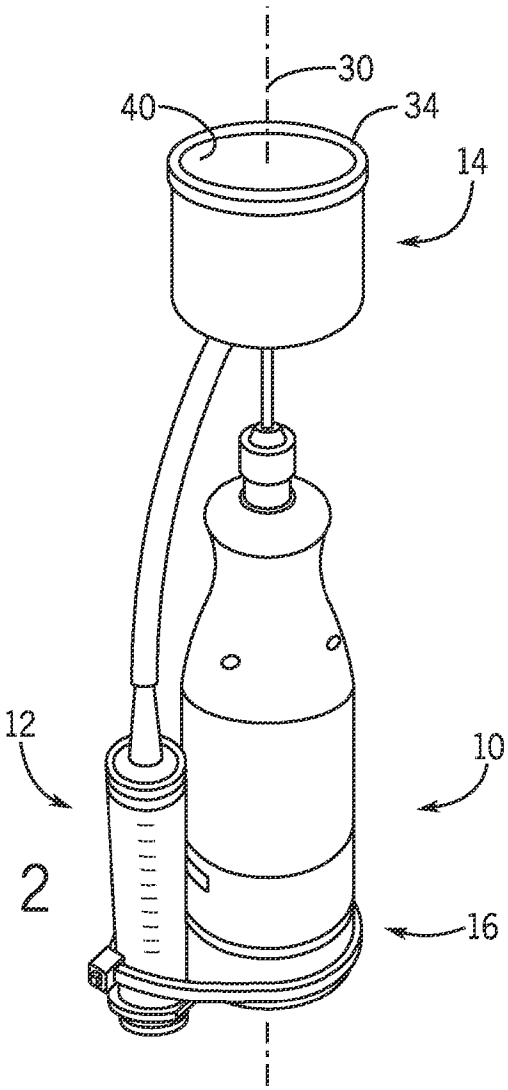
FIG. 2 is a top perspective view of an embodiment of the cordless spray device of FIG. 1.

FIG. 2 is a top perspective view of an embodiment of the cordless spray device 10 of FIG. 1. As illustrated, the bell cup 34 of the rotary atomizer 14 has a generally annular inner surface 40 that gradually diverges away from the rotational axis 30 of the cordless spray device 10. For example, the annular inner surface 40 may include a conical surface, a parabolic surface, a cylindrical surface, or any combination of one or more of these surface geometries. Furthermore, the surface 40 may be a smooth surface, a textured surface, a ribbed surface, or any combination thereof.

Figure 3:
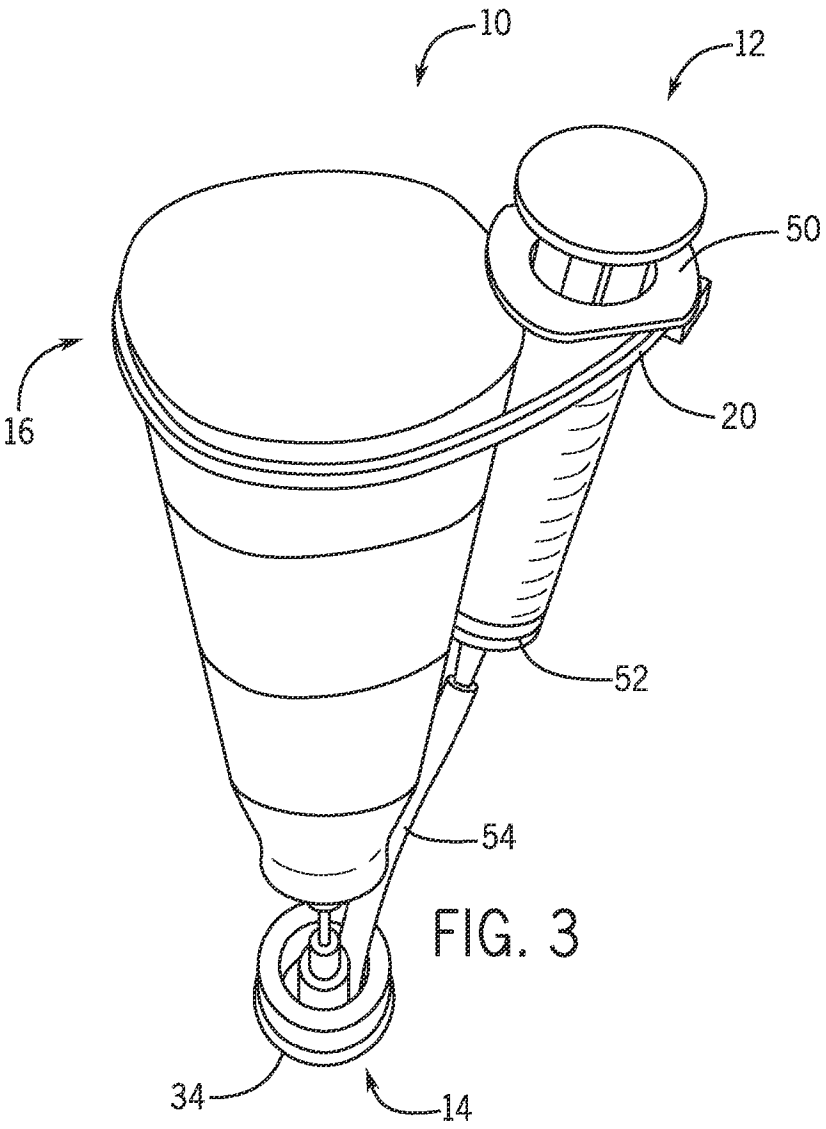
FIG. 3 is a bottom perspective view of an embodiment of the cordless spray device of FIG. 1.

FIG. 3 is a bottom perspective view of an embodiment of the cordless spray device 10 of FIG. 1. As illustrated, the syringe 12 is coupled to the battery powered drive 16 via the mounting features 20. The illustrated mounting feature 20 extends around both the syringe 12 and the casing 22 at a first end 50 of the syringe 12, while an opposite second end 52 of the syringe 12 is supported by a tubing 54 extending to the rotary atomizer 14. The mounting feature 20 is illustrated as a single strap, e.g., a plastic or metal band. In other embodiments, the syringe 12 may be supported by other fasteners or mounts.

Figure 4:
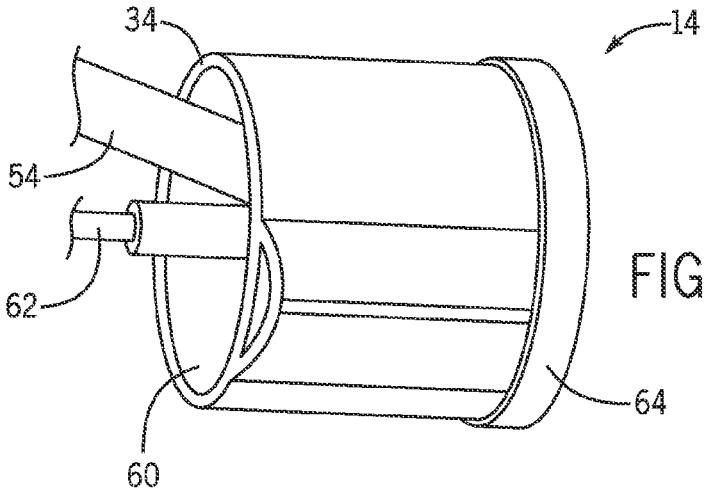
FIG. 4 is a partial perspective view of an embodiment of the cordless spray device of FIG. 1, illustrating an embodiment of the rotary atomizer.

FIG. 4 is a partial perspective view of an embodiment of the cordless spray device 10 of FIG. 1, illustrating an embodiment of the rotary atomizer 14. As illustrated, the tubing 54 extends to a first end 60 of the bell cup 34, such that the syringe 12 is able to direct the liquid into the bell cup 34 for rotary atomization along the surface 40 (FIG. 2). The bell cup 34 is driven to rotate or spin by a shaft 62 coupled to the drive 24 of the battery powered drive 16. As the bell cup 34 rotates, the liquid supplied from the tubing 54 is forced to flow along the rotating surface 40 until the liquid exits at a second end 64 of the bell cup 34. At this point, the liquid becomes atomized as a spray.

Figure 5:
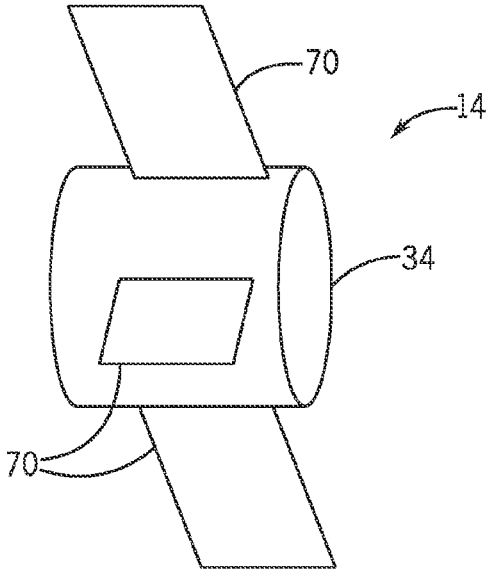
FIG. 5 is a schematic side view of an embodiment of the rotary atomizer of FIGS. 1-4, illustrating a plurality of propellers protruding from a bell cup.

FIG. 5 is a schematic side view of an embodiment of the rotary atomizer 14 of FIGS. 1-4, illustrating a plurality of propellers 70 protruding from the bell cup 34. As appreciated, the propellers 70 may aid in directing the spray toward a target object. For example, the propellers 70 may generate an airflow to guide the spray away from the cordless spray device 10 toward the target object to reduce splatter on the device 10 and to improve the transfer efficiency to the target object. However, in certain embodiments, the propellers 70 do not have any impact on atomization of the liquid. In other words, the propellers 70 may be used to simply guide the already atomized liquid spray.

Figure 6:
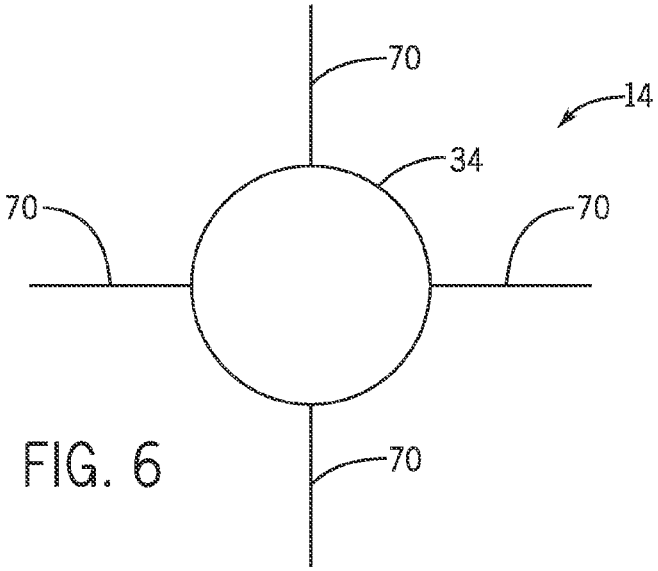
FIG. 6 is a schematic end view of an embodiment of the rotary atomizer of FIG. 5.

FIG. 6 is a schematic end view of an embodiment of the rotary atomizer 14 of FIG. 5, illustrating a set of four propellers 70 evenly spaced about the bell cup 34. Although the illustrated embodiment includes four propellers 70, other embodiments may include any number (e.g., 1, 2, 3, 4, 5, 6, 7, 8, 9, 10, or more) of propellers in any suitable arrangement.

Figure 7:
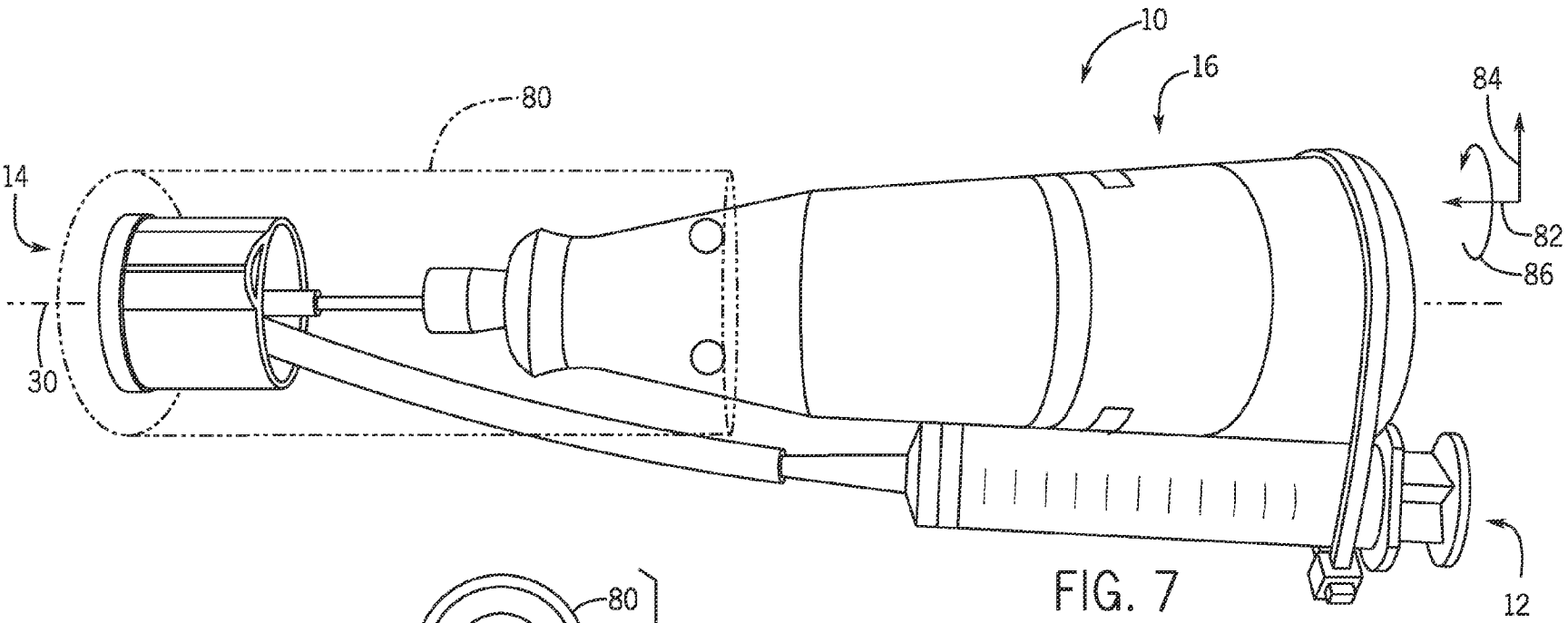
FIG. 7 is a side perspective view of an embodiment of a cordless spray device having an adjustable spray guard.

FIG. 7 is a side perspective view of an embodiment of a cordless spray device 10 having an adjustable spray guard 80. As illustrated, the adjustable spray guard 80 surrounds the rotary atomizer 14, and is configured to block splatter of the spray on the device 10 and aid in directing the spray toward a target object. The spray guard 80 may be adjustable in an axial direction 82, a radial direction 84, and/or a circumferential direction 86 relative to the rotational axis 30 of the device 10. Accordingly, the spray guard 80 may be adjustable based on various parameters, such as the type of liquid, the rotational speed, the environmental conditions (e.g., wind), and so forth.

Figure 8:
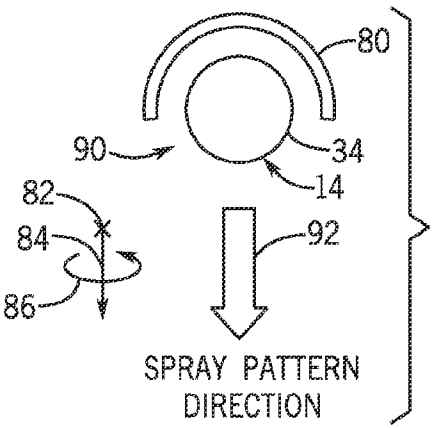
FIG. 8 is a schematic end view of an embodiment of the cordless spray device of FIG. 7, illustrating the adjustable spray guard extending partially about a bell cup of the rotary atomizer.

FIG. 8 is a schematic end view of an embodiment of the cordless spray device 10 of FIG. 7, illustrating the adjustable spray guard 80 extending partially about the bell cup 34 of the rotary atomizer 14. As illustrated, the spray guard 80 extends approximately 180 degrees circumferentially 86 about the bell cup 34, such that the spray guard 80 leaves an opening 90 of approximately 180 degrees. In this manner, the spray guard 80 helps to direct a spray 92 through the opening 90 away from the cordless spray device 10. In the illustrated embodiment, the opening 90 is oriented in the radial direction 84, such that the guard 80 directs the spray 92 to flow in the radial direction 84. In other embodiments, the guard 80 may direct the spray 92 in other directions. Furthermore, the guard 80 may extend any circumferential distance about the bell cup 34, e.g., 90 to 270 degrees, 150 to 210 degrees, or approximately 180 degrees.

Figure 9:
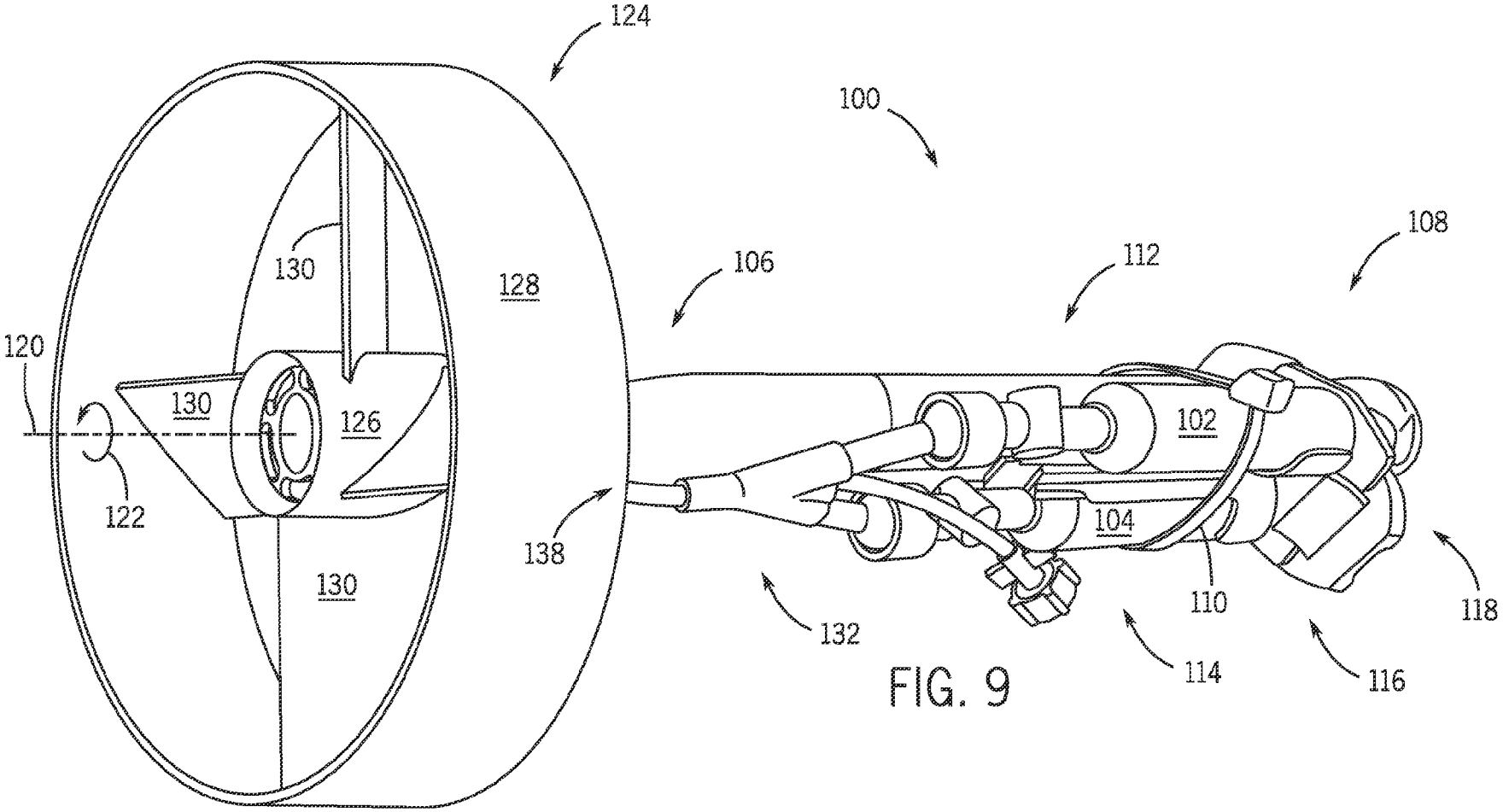
FIG. 9 is a side perspective view of an embodiment of a cordless spray device having first and second syringes to supply a substance to a rotary atomizer driven by a battery powered drive.

FIG. 9 is a side perspective view of an embodiment of a cordless spray device 100 having first and second syringes 102 and 104 to supply a substance to a rotary atomizer 106 driven by a battery powered drive 108. As illustrated, each syringe 102 and 104 may be a plastic syringe with markings to indicate a quantity of liquid applied to the rotary atomizer 106. Furthermore, each syringe 102 and 104 may be removably mounted to the battery powered drive 108 via a variety of mounting features 110, such as a strap, clamp, screws, bolts, snap-fit couplings, or other fasteners. For example, the mounting features 110 may be an adjustable strap, such as a metal or plastic strap, with a plurality of positions to adjust the tightness of clamping the syringes 102 and 104 onto the battery powered drive 108. Each syringe 102 and 104 also may be a reusable syringe, a disposable syringe, a recyclable syringe, a pre-filled syringe (e.g., pre-filled with a paint or other coating liquid), a user Tillable syringe, or any combination thereof.

As appreciated, the battery powered drive 108 includes a body or casing 112 that supports an internal drive 114 (e.g., an electric motor) coupled to a battery 116. In other embodiments, the battery 116 may be replaced or supplemented with another power supply contained within the casing 112, e.g., one or more capacitors. Furthermore, the battery powered drive 108 may be a rechargeable unit, and thus may include a recharge connection, such as a docking station connection 118.

As discussed in further detail below, the rotary atomizer 106 may be driven by the internal drive 114 to rotate about a rotational axis 120, as indicated by arrow 122. As the rotary atomizer 106 rotates, the liquid from the syringes 102 and/or 104 may be fed to the atomizer 106, such that the atomizer 106 spins the liquid to cause atomization of the liquid into a spray. For example, the rotary atomizer 106 may include a propeller 124 having a central hub 126, an outer ring or shroud 128, and a plurality of blades 130 extending between the central hub 126 and the outer shroud 128. In operation, the internal drive 114 forces the propeller 124 to rotate about the axis 30 to cause rotary atomization of the liquid passing into the blades 130 between the central hub 126 and the outer shroud 128.

Figure 10:
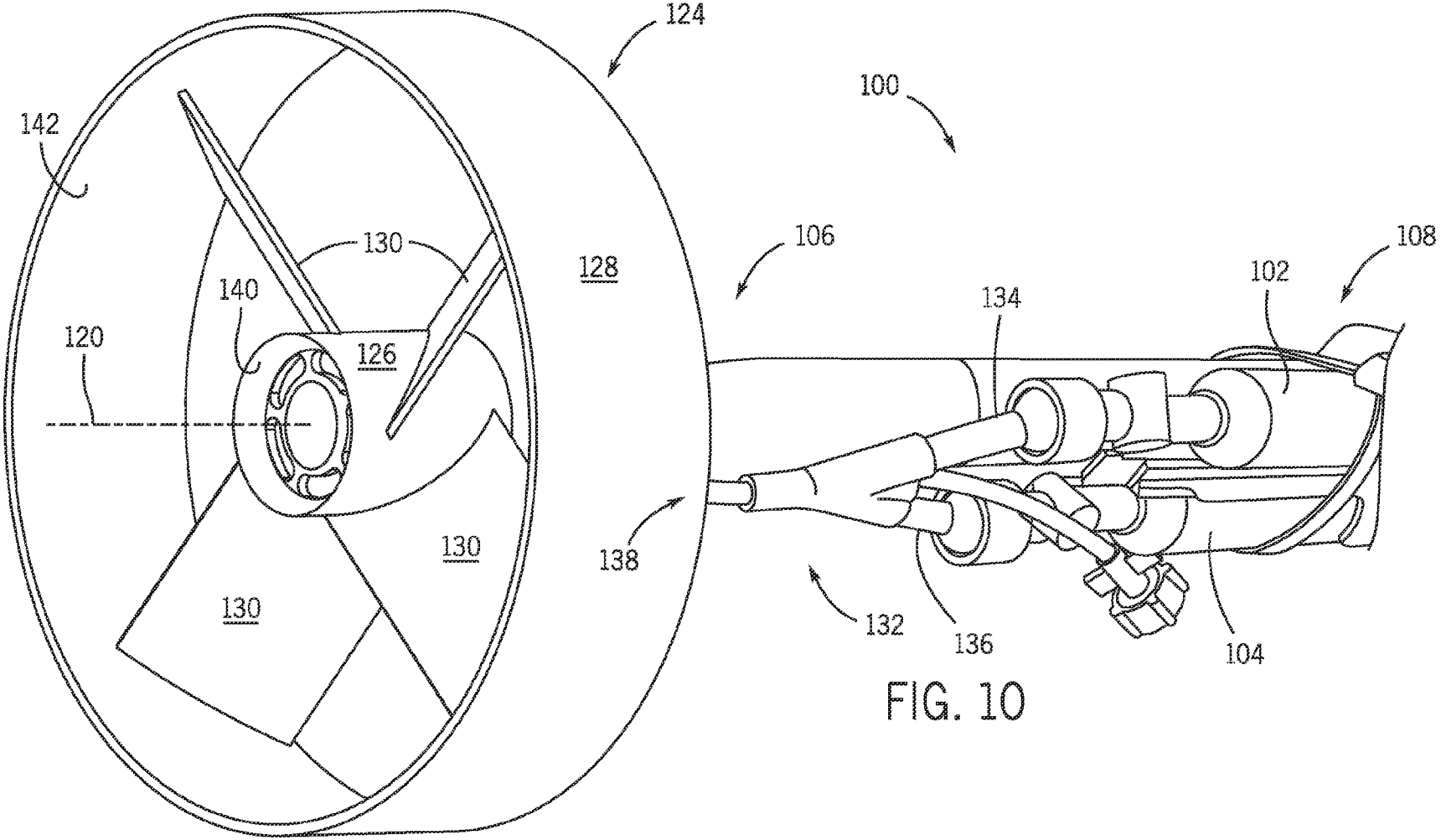
FIG. 10 is a side perspective view of an embodiment of the cordless spray device of FIG. 9, further illustrating a propeller of the rotary atomizer.

FIG. 10 is a side perspective view of an embodiment of the cordless spray device 100 of FIG. 9, further illustrating the propeller 124 of the rotary atomizer 106. As illustrated, the syringes 102 and/or 104 may are configured to feed a liquid to the propeller 124 through one or more fluid conduits 132, such as fluid conduits 134, 136, and 138. For example, the syringe 102 couples to the fluid conduit 134, the syringe 104 couples to the fluid conduit 136, and the fluid conduits 134 and 136 both couple to (or converge into) the fluid conduit 138. In turn, the fluid conduit 138 extends further downstream to a position in close proximity to the propeller 124, thereby enabling the fluid conduit 138 to inject a stream of liquid directly into the propeller 124 to facilitate atomization as the liquid impinges against the rotating blades 130.

In the illustrated embodiment, the central hub 126 and the outer shroud 128 are generically coaxial or concentric with one another, and each have a generally annular shape. For example, the central hub 126 may have an annular exterior 140, while the outer shroud 128 has an annular interior 142. The annular exterior 140 and the annular interior 142 may be a cylindrical shape, a conical shape, a curved annular shape (e.g., a parabolic shape), or any combination thereof Furthermore, the annular exterior 140 and the annular interior 142 may be generally parallel, converging, or diverging relative to one another in a downstream axial direction along the axis 120. The annular exterior 140 and the annular interior 142 also may have a smooth surface, a textured surface, a ribbed surface, or any combination thereof The blades 130 between the central hub 126 and the outer shroud 128 also may have a variety of configurations. For example, the blades 130 may have an airfoil shaped geometry, a rectangular geometry, or any other suitable shape. Furthermore, the propeller 124 may have any number of blades 130, such as 2 to 20 blades (e.g., 3, 4, 5, 6, 7, 8, 9, 10, or more blades). The angle or pitch of each blade 130 also may vary between 10 to 80, 20 to 70, 30 to 60, or 40 to 50 degrees relative to the axis 120. In the illustrated embodiment, the blades 130 are integral with the central hub 126 and the outer shroud 130, thereby defining a one-piece propeller 124 that may be made of a lightweight material such as a plastic or composite material.

Figure 11:
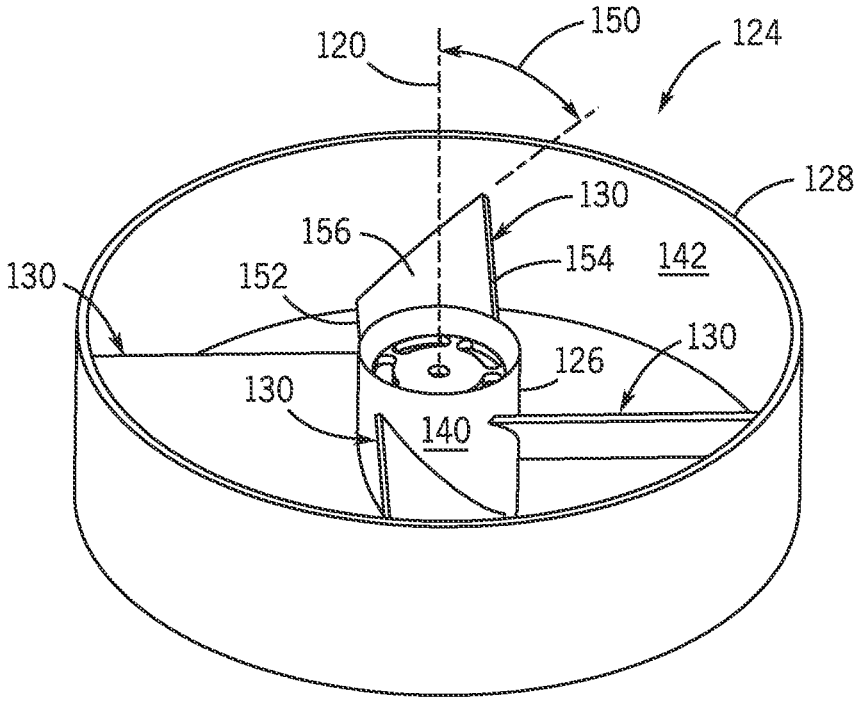
FIG. 11 is a perspective view of an embodiment of the propeller of the rotary atomizer of FIGS. 9 and 10.

FIG. 11 is a perspective view of an embodiment of the propeller 124 of the rotary atomizer 106 of FIGS. 9 and 10. As further illustrated in FIG. 11, the annular exterior 140 and the annular interior 142 are generally cylindrical surfaces that are coaxial or concentric with one another. Furthermore, the illustrated embodiment of the propeller 124 has a set of four blades 130 equally spaced between the central hub 126 and the outer shroud 128. Each blade 130 has an angle 150 relative to the axis 120, a leading edge 152 at an upstream end of the blade 130, a trailing edge 154 at a downstream end of the blade 132, and a profile 156 between the leading edge 152 and the trailing edge 154. In certain embodiments, the profile 156 of each blade 130 may include a linear portion, a non-linear portion (e.g., a curved portion), or any combination thereof. Accordingly, the angle 150 of each blade 130 may be constant or variable between the leading edge 152 and the trailing edge 154, thereby helping to control the efficiency of atomization of the liquid from the fluid conduit 138. The design of each blade 130 also may vary the distribution of the spray downstream of the propeller 124.

Figure 12:
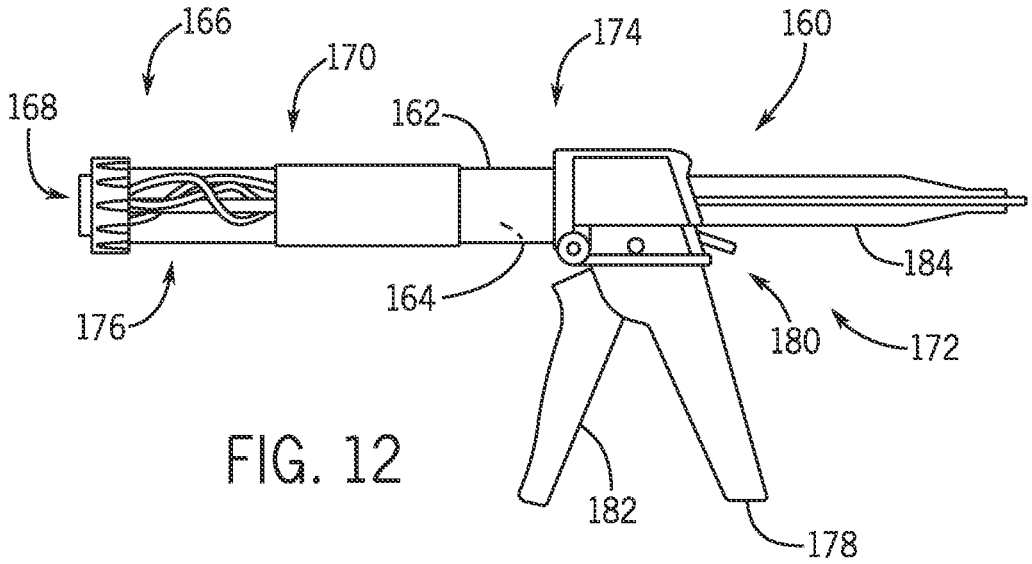
FIG. 12 is a side perspective view of an embodiment of a cordless spray device having first and second syringes to supply a substance to a spray head having a plurality of opposing orifices (e.g., cat-eye shaped orifices)

FIG. 12 is a side perspective view of an embodiment of a cordless spray device 160 having first and second syringes 162 and 164 to supply a substance to a spray head 166 having a plurality of opposing orifices 168 (e.g., cat-eye shaped orifices). As illustrated, the spray device 160 includes a barrel portion 170 coupled to a handle portion 172 at a break action mechanism 174, which enables the barrel portion 170 to hingedly rotate away from the handle portion 172 to enable loading and unloading of liquid and/or cartridges in the syringes 162 and 164. The barrel portion 170 includes the first and second syringes 162 and 164, the spray head 166, and a fluid supply section 176 between the syringes 162 and 164 and the spray head 166. The handle portion 172 includes a handle 178 and an actuator assembly 180, which includes a trigger assembly 182 coupled to a ratcheting mechanism 184.

Figure 13:
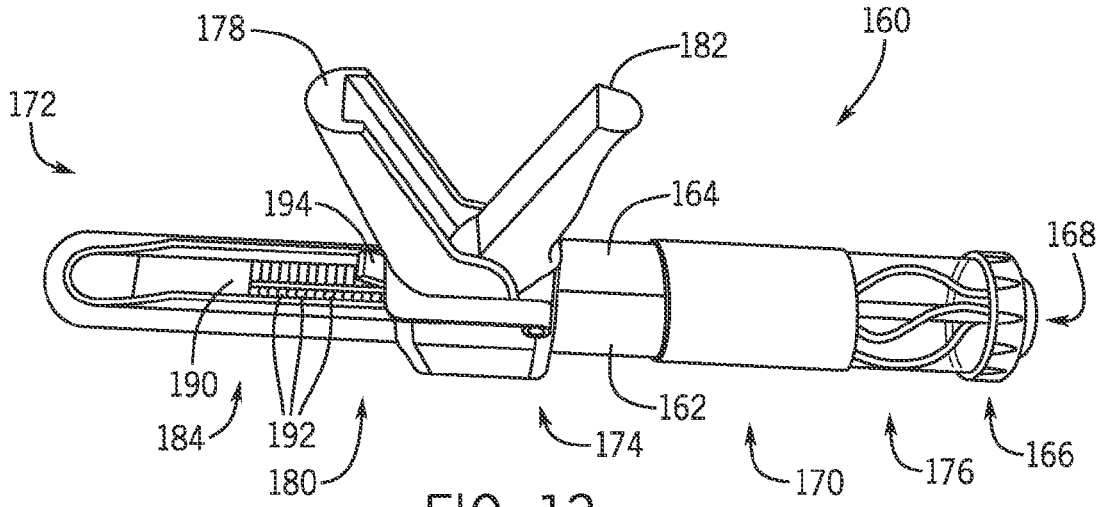
FIG. 13 is a bottom perspective view of an embodiment of the cordless spray device of FIG. 12, illustrating an actuator assembly having a trigger assembly coupled to a ratcheting mechanism.

FIG. 13 is a bottom perspective view of an embodiment of the cordless spray device of FIG. 12, illustrating the actuator assembly 180 having the trigger assembly 182 coupled to the ratcheting mechanism 184. As further illustrated in FIG. 13, the ratcheting mechanism 184 includes a ratcheting track 190 having a series of ridges 192, which selectively snap fit with a ratcheting catch 194. For example, as an operator pulls the trigger assembly 182, the actuator assembly 180 is configured to drive fluid through the syringes 162 and 164 (e.g., by driving first and second plungers in the syringes 162 and 164), while the ratcheting catch 192 moves over the series of ridges 192. Upon release of the trigger assembly 182, the ratcheting catch 192 remains in position along the series of ridges 192, thereby holding the position of the plungers until the operator pulls the trigger assembly 182 again to further drive the plungers into the syringes 162 and 164. Thus, the operator may repeatedly pull and release the trigger assembly 182 to progressively drive the plungers into the syringes 162 and 164, and thus drive the liquid out of the syringes 162 and 164 to the spray head 166. The liquid is then atomizes as it exits through the plurality of opposing orifices 168 in the spray head 166. The operator may release the pressure in the syringes 162 and 164, and back off the ratcheting mechanism 184, by depressing a release, such as the catch 192 itself.

Figure 14:
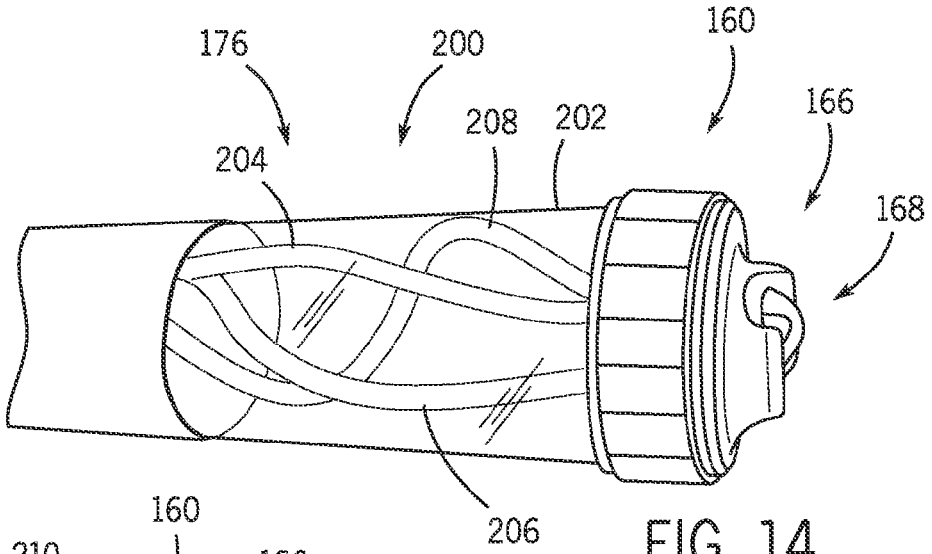
FIG. 14 is a partial side perspective view of an embodiment of the cordless spray device of FIG. 12, illustrating a plurality of tubes extending through a sleeve to the spray head.

FIG. 14 is a partial side perspective view of an embodiment of the cordless spray device 160 of FIG. 12, illustrating the fluid supply section 176 with a plurality of tubes 200 extending through a sleeve 202 to the spray head 166. In the illustrated embodiment, the tubes 200 include a first tube 204, a second tube 206, and a third tube 208, which lead to the plurality of opposing orifices 168 in the spray head 166. The tubes 200 may be flexible tubes, such as rubber or plastic tubing. Furthermore, sleeve 202 and the tubes 200 may be translucent or transparent to facilitate viewing of the liquid flow through the tubes 200 to the spray head 166.

Figure 15:
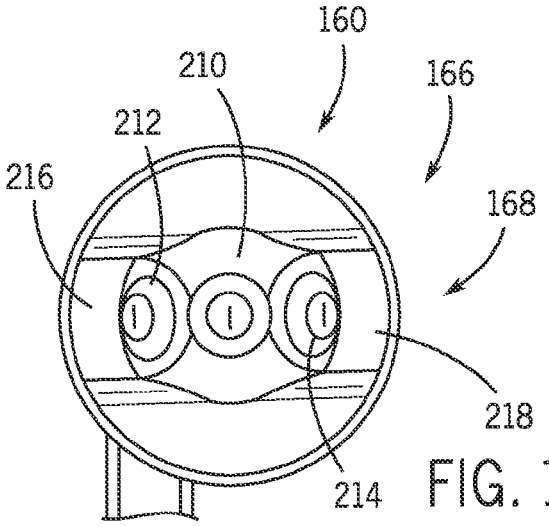
FIG. 15 is a front perspective view of an embodiment of the cordless spray device of FIG. 12, illustrating the plurality of opposing orifices (e.g., two lateral shaped orifices disposed about a central orifice)

FIG. 15 is a front perspective view of an embodiment of the cordless spray device 160 of FIG. 12, illustrating the plurality of opposing orifices 168 that couple to the plurality of tubes 200 in the fluid supply section 176. In particular, the orifices 168 include a central orifice 210, a first lateral orifice 212, and a second lateral orifice 214. The central orifice 210 is sandwiched between the first and second lateral orifices 212 and 214. Furthermore, the first and second lateral orifices 212 and 214 are disposed on respective first and second raised portions or horns 216 and 218, which extend axially downstream from the central orifice 210. With reference to FIGS. 14 and 15, the first, second, and third tubes 204, 206, and 208 are coupled to the respective central orifice 210, first orifice 212, and second orifice 214. Accordingly, the spray device 160 may enable simultaneous feeds in equal or different proportions to the orifices 210, 212, and 214, thereby enabling control of the atomization and shape of the forming spray. For example, the first syringe 162 may be fluidly coupled to the central orifice 210, while the second syringe 164 may be fluidly coupled to the first and second orifices 212 and 214. Thus, the first syringe 162 may supply a first liquid at a first flow rate to the central orifice 210, while the second syringe 164 may supply a second liquid at a second flow rate to the first and second orifices 212 and 214. In certain embodiments, the orifices 210, 212, and 214 may have one or more equal or different characteristics, such as the shape and/or size of the orifice. For example, one or more (e.g., all) of the orifices 210, 212, and 214 may have a round orifice, a cat-eye shaped orifice, a rectangular orifice, a triangular orifice, an oval orifice, or any combination thereof.

Figure 16:
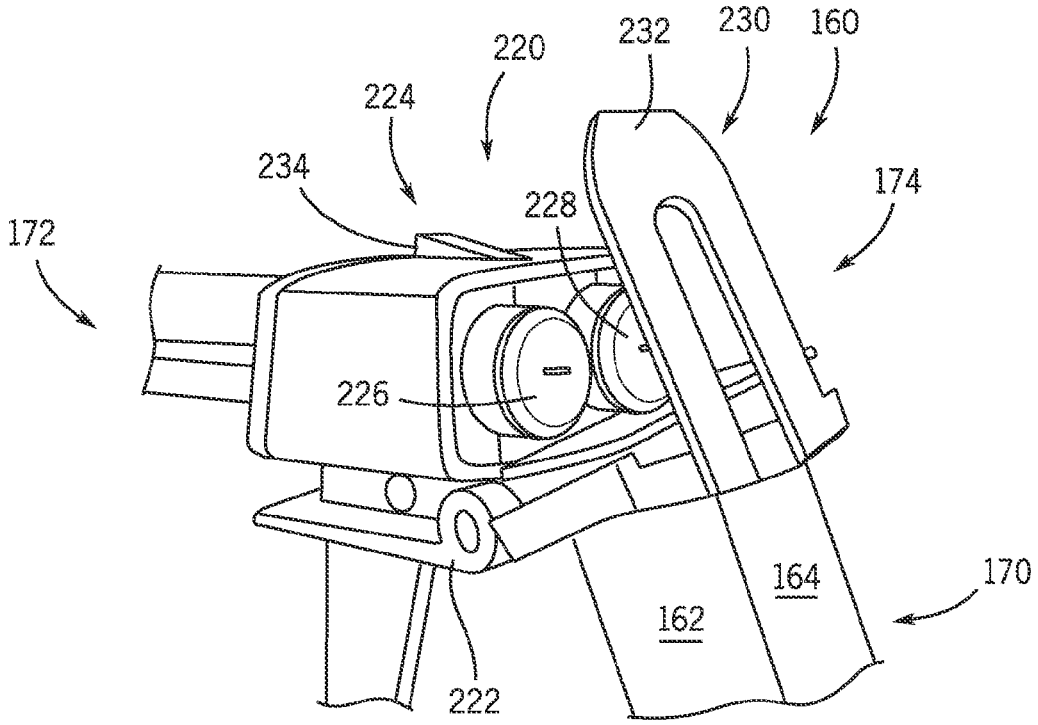
FIG. 16 is a partial perspective view of an embodiment of the cordless spray device of FIG. 12, illustrating a break-action having a double barrel applicator assembly.

FIG. 16 is a partial perspective view of an embodiment of the cordless spray device 160 of FIG. 12, illustrating the break-action mechanism 174 having a double barrel applicator assembly 220. As illustrated, the break-action mechanism 174 has a hinge or rotatable joint 222 between the barrel portion 170 and the handle portion 172, thereby enabling the barrel portion 170 to hingedly rotate away from the handle portion 172 as shown in the open position. The double barrel applicator assembly 200 includes a plunger assembly 224 having a first plunger 226 aligned with the first syringe 162 and a second plunger 228 aligned with the second syringe 164. In operation, the plungers 226 and 228 are driven along the syringes 162 and 164 to force the liquid to flow to the spray head 166, and out through the orifices 168. After filling the syringes 162 and 164, the barrel portion 170 may hingedly rotate toward the handle portion 172 to a closed position, which is then secured by a locking mechanism 230. In the illustrated embodiment, the locking mechanism 230 includes first and second locking portions 232 and 234, which latch or snap fit together to hold the barrel portion 170 in the closed position relative to the handle portion 172.

Figure 17:
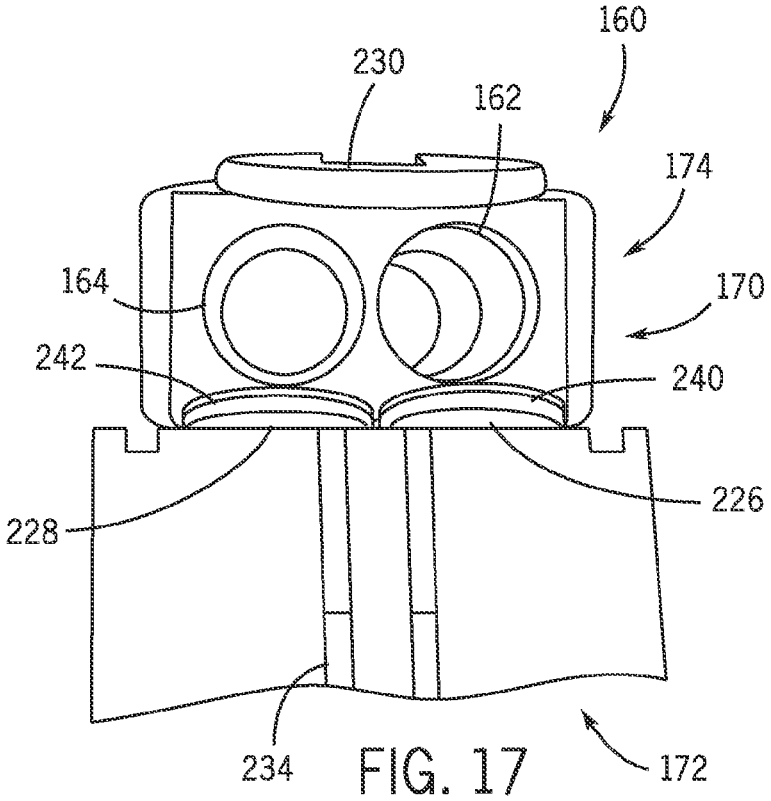
FIG. 17 is a partial perspective view of an embodiment of the double barrel applicator assembly of FIG. 16.

FIG. 17 is a partial perspective view of an embodiment of the double barrel applicator assembly 220 of FIG. 16. As further illustrated, the plunger 228 aligns with the syringe 164, while the plunger 226 aligns with the syringe 164. Furthermore, the plunger 226 includes at least one o-ring or seal 240, while the plunger 228 also includes at least one o-ring or seal 242. These seals 240 and 240 are configured to help seal the volume of each syringe 162 and 164 during a stroke of the plungers 226 and 228, thereby helping to efficiently build pressure in the syringes 162 and 164 and transfer the liquid to the spray head 166.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a portable spray device, comprising:

a battery powered drive;

a rotary atomizer driven by the battery powered drive, wherein the rotary atomizer comprises a bell cup having an inner annular surface; and a syringe configured to supply a liquid to the inner annular surface of the bell cup, wherein the rotary atomizer is configured to rotate the bell cup to atomize the liquid into a spray.

2. The system of claim 1, wherein the inner annular surface of the bell cup comprises a conical surface, a parabolic surface, a cylindrical surface, or a combination thereof.

3. The system of claim 1, wherein the rotary atomizer comprises a plurality of propellers coupled to the bell cup.

4. The system of claim 3, wherein the plurality of propellers are configured to generate an air flow to guide the spray toward a target object.

5. The system of claim 1, wherein the portable spray device is configured to atomize the liquid without a pressurized gas flow.

6. The system of claim 1, wherein the portable spray device is a handheld spray device.

7. The system of claim 1, wherein the portable spray device comprises an adjustable guard extending about the rotary atomizer.

8. The system of claim 7, wherein the adjustable guard extends partially circumferentially about a rotational axis of the rotary atomizer, and the adjustable guard has a lateral opening configured to direct the spray to flow in a radial direction away from the rotational axis.

9. The system of claim 8, wherein the adjustable guard extends a circumferential distance about the rotational axis of between 90 to 270 degrees.

10. The system of claim 8, wherein the adjustable guard is adjustable in an axial direction, a radial direction, a circumferential direction, or a combination thereof.

11. The system of claim 1, wherein the battery powered drive comprises a battery powered electric motor.

12. The system of claim 1, wherein the syringe is removably coupled to the battery powered drive via a mounting feature.

13. The system of claim 12, wherein the syringe is removably coupled to an outer surface of the battery powered drive.

14. The system of claim 12, wherein the mounting feature comprises a strap, a clamp, a fastener, or a combination thereof.

15. The system of claim 1, wherein the syringe is manually actuated to supply the liquid to the bell cup.

16. The system of claim 1, wherein the syringe comprises tubing positioned adjacent to the inner annular surface of the bell cup to supply the liquid to the bell cup.

17. The system of claim 1, wherein the inner annular surface comprises a smooth surface, a textured surface, a ribbed surface, or a combination thereof.

18. The system of claim 1, wherein the battery powered drive comprises a rechargeable unit having a recharge connection.

19. The system of claim 1, wherein the portable spray device is a portable spray coating device, and the liquid is a coating liquid.

20. The system of claim 1, wherein the syringe comprises the liquid, and the liquid is a coating liquid.

* * * * *